US010753187B2

(12) United States Patent
Hughes et al.

(10) Patent No.: US 10,753,187 B2
(45) Date of Patent: Aug. 25, 2020

(54) DOWNHOLE WET GAS COMPRESSOR PROCESSOR

(71) Applicant: GE Oil & Gas ESP, Inc., Oklahoma City, OK (US)

(72) Inventors: Michael Franklin Hughes, Oklahoma City, OK (US); Jeremy Daniel Van Dam, Niskayuna, NY (US); Vittorio Michelassi, Niskauna, NY (US); Scott Alan Harban, Oklahoma City, OK (US); Rene Du Cauze De Nazelle, Garching b. Munchen (DE)

(73) Assignee: GE Oil & Gas ESP, Inc., Oklahoma City, OK (US)

( * ) Notice: Subject to any disclaimer, the term of this patent is extended or adjusted under 35 U.S.C. 154(b) by 855 days.

(21) Appl. No.: 15/517,067

(22) PCT Filed: Feb. 24, 2015

(86) PCT No.: PCT/US2015/017182
§ 371 (c)(1),
(2) Date: Apr. 5, 2017

(87) PCT Pub. No.: WO2015/127410
PCT Pub. Date: Aug. 27, 2015

(65) Prior Publication Data

US 2017/0306734 A1 Oct. 26, 2017

Related U.S. Application Data

(60) Provisional application No. 61/943,866, filed on Feb. 24, 2014.

(51) Int. Cl.
*E21B 43/12* (2006.01)
*F04D 31/00* (2006.01)
(Continued)

(52) U.S. Cl.
CPC ..... *E21B 43/128* (2013.01); *E21B 43/126* (2013.01); *E21B 47/0007* (2013.01);
(Continued)

(58) Field of Classification Search
CPC ..... F04D 29/464; E21B 43/128
See application file for complete search history.

(56) References Cited

U.S. PATENT DOCUMENTS 2,083,447 A * 6/1937 Hoffmann ..... F04D 29/464 138/39
2,422,615 A * 6/1947 Halford ..... F04D 29/284 416/188
(Continued)

FOREIGN PATENT DOCUMENTS

EP 0 468 877 A1 1/1992
EP 2 093 429 A1 8/2009
(Continued)

OTHER PUBLICATIONS

Office Action and Search Report issued in connection with corresponding RU Application No. 2016133288 dated Jun. 27, 2018.
(Continued)

*Primary Examiner* — Blake E Michener
(74) *Attorney, Agent, or Firm* — Crowe & Dunlevy

(57) ABSTRACT

A fluid processor for use in a downhole pumping operation includes a fluid processing stag, a nozzle stage and a gas compressor stage. The nozzle chamber is configured as a convergent-divergent nozzle and the variable metering member is configured for axial displacement within the convergent section to adjust the open cross-sectional area of the nozzle. A method for producing fluid hydrocarbons from a subterranean wellbore with a pumping system includes the steps of measuring a first gas-to-liquid ratio of the fluid hydrocarbons and operating a motor within the pumping
(Continued)

system to operate at a first rotational speed. The method continues with the steps of measuring a second gas-to-liquid ration of the fluid hydrocarbons with the sensor module, where the second gas-to-liquid ratio is greater than the first gas-to-liquid ratio, and operating the motor at a second rotational speed that is faster than the first rotational speed.

15 Claims, 7 Drawing Sheets

(51) Int. Cl.

| | |
|---|---|
| ***F04D 29/46*** | (2006.01) |
| ***F04D 29/32*** | (2006.01) |
| ***F04D 29/22*** | (2006.01) |
| ***F04D 13/10*** | (2006.01) |
| ***F04D 29/28*** | (2006.01) |
| ***E21B 47/06*** | (2012.01) |
| ***F01D 5/02*** | (2006.01) |
| ***F01D 5/14*** | (2006.01) |
| ***E21B 47/00*** | (2012.01) |
| ***F01D 9/02*** | (2006.01) |

(52) U.S. Cl.
CPC ..... *E21B 47/06* (2013.01); *E21B 47/065* (2013.01); *F01D 5/023* (2013.01); *F01D 5/147* (2013.01); *F01D 9/02* (2013.01); *F04D 13/10* (2013.01); *F04D 29/22* (2013.01); *F04D 29/284* (2013.01); *F04D 29/321* (2013.01); *F04D 29/464* (2013.01); *F04D 31/00* (2013.01); *F05D 2220/20* (2013.01)

(56) References Cited

U.S. PATENT DOCUMENTS

| | | | | | |
|---|---|---|---|---|---|
| 2,557,435 | A * | 6/1951 | Imbert | F02K 1/08 | 239/265.25 |
| 2,991,721 | A | 7/1961 | Foster | | |
| 3,123,285 | A * | 3/1964 | Lee | F02C 7/04 | 137/15.1 |
| 3,143,078 | A * | 8/1964 | Gaslow | F04D 13/04 | 417/365 |
| 3,204,863 | A * | 9/1965 | Hausammann | F04D 15/0038 | 415/150 |
| 3,217,654 | A * | 11/1965 | Springer | F04D 29/2277 | 415/121.1 |
| 3,438,329 | A * | 4/1969 | Fuller | F04D 29/448 | 415/199.3 |
| 4,292,011 | A | 9/1981 | Erickson | | |
| 4,502,837 | A * | 3/1985 | Blair | F01D 5/045 | 415/198.1 |
| 4,573,868 | A * | 3/1986 | Stroem | F04D 29/56 | 415/157 |
| 4,678,396 | A * | 7/1987 | Mowill | F04D 29/464 | 415/148 |
| 5,755,554 | A * | 5/1998 | Ryall | F04D 3/00 | 415/199.4 |
| 5,961,282 | A * | 10/1999 | Wittrisch | E21B 43/121 | 415/199.6 |
| 6,167,965 | B1 | 1/2001 | Bearden et al. | | |
| 6,474,939 | B1 | 11/2002 | Bratu | | |
| 6,807,802 | B2 * | 10/2004 | Platts | F01D 5/022 | 60/39.43 |
| 7,044,718 | B1 * | 5/2006 | Platts | F02C 3/045 | 415/206 |
| 9,574,562 | B2 * | 2/2017 | Van Dam | F04D 29/183 | |
| 2002/0011337 | A1 * | 1/2002 | Grant | E21B 43/121 | 166/372 |
| 2002/0187037 | A1 * | 12/2002 | Lee | E21B 43/128 | 415/1 |
| 2004/0109757 | A1 * | 6/2004 | Nenstiel | F04D 27/0253 | 415/151 |
| 2006/0245945 | A1 | 11/2006 | Wilson et al. | | |
| 2010/0284829 | A1 * | 11/2010 | Sloteman | F04D 9/003 | 417/199.1 |
| 2011/0123321 | A1 * | 5/2011 | Kilkenny | F04D 29/185 | 415/185 |
| 2011/0280706 | A1 * | 11/2011 | Meuter | F04D 29/047 | 415/1 |
| 2011/0280741 | A1 * | 11/2011 | Meuter | F04D 29/047 | 417/205 |
| 2012/0057965 | A1 * | 3/2012 | Bergamini | F04D 3/00 | 415/143 |
| 2012/0201660 | A1 | 8/2012 | Aalburg et al. | | |
| 2014/0300231 | A1 * | 10/2014 | Delgado Marquez | H02K 5/1672 | 310/90 |
| 2015/0044026 | A1 * | 2/2015 | Kilkenny | F04D 7/02 | 415/72 |
| 2015/0044027 | A1 * | 2/2015 | Van Dam | F04D 29/183 | 415/73 |
| 2017/0319995 | A1 * | 11/2017 | Gupta | B01F 5/0652 | |
| 2019/0048886 | A1 * | 2/2019 | Reed | E21B 43/128 | |

FOREIGN PATENT DOCUMENTS

| | | | |
|---|---|---|---|
| EP | 2 484 912 | A2 | 8/2012 |
| GB | 1 445 356 | A | 3/2011 |
| WO | 2007/075781 | A2 | 7/2007 |
| WO | 2011/031603 | A1 | 3/2011 |
| WO | 2015/136997 | A1 | 9/2015 |

OTHER PUBLICATIONS

Decision to Grant issued in connection with corresponding RU Application No. 2016133288 dated Oct. 24, 2018.

Invitation to Pay Additional Fees issued in connection with corresponding PCT Application No. PCT/US2015/017182 dated Dec. 4, 2015.

International Search Report and Written Opinion issued in connection with corresponding PCT Application No. PCT/US2015/017182 dated May 10, 2016.

International Preliminary Report on Patentability issued in connection with corresponding PCT Application No. PCT/US2015/017182 dated Aug. 30, 2016.

* cited by examiner

DOWNHOLE WET GAS COMPRESSOR PROCESSOR

BACKGROUND

Embodiments of the invention generally relate to the field of submersible pumping systems, and more particularly, but not by way of limitation, to a system designed to produce fluids with a high gas fraction from subterranean wells that may also include significant volumes of liquid.

Submersible pumping systems are often deployed into wells to recover petroleum fluids from subterranean reservoirs. Typically, the submersible pumping system includes a number of components, including one or more fluid filled electric motors coupled to one or more high performance pumps located above the motor. When energized, the motor provides torque to the pump, which pushes wellbore fluids to the surface through production tubing. Each of the components in a submersible pumping system must be engineered to withstand the inhospitable downhole environment.

Some reservoirs contain a higher volume of gaseous hydrocarbons than liquid hydrocarbons. In these reservoirs, it is desirable to install recovery systems that are designed to handle fluids with higher gas fractions. Prior art gas handling systems are generally effective at producing gaseous fluids, but tend to fail or perform poorly when the exposed to significant volumes of liquid. Many wells initially produce a higher volume of liquid or produce higher volumes of liquid on an intermittent basis. The sensitivity of prior art gas handling systems to liquids presents a significant problem in wells that produce predominantly gaseous hydrocarbons but that nonetheless produce liquids at start-up or on an intermittent basis. It is to these and other deficiencies in the prior art that the embodiments of present invention are directed.

BRIEF DESCRIPTION

In some embodiments, the present invention includes a fluid processor for use in a downhole pumping operation. The fluid processor includes a fluid processing stage, a nozzle stage and a gas compressor stage. The fluid processing stage may include an impeller and a diffuser. The nozzle stage may include a nozzle chamber and a variable metering member. The nozzle chamber is configured as a convergent-divergent nozzle and the variable metering member is configured for axial displacement within the convergent section to adjust the open cross-sectional area of the nozzle. The gas compressor stage includes one or more gas compressor turbines.

In another aspect, some embodiments include a method for producing fluid hydrocarbons from a subterranean wellbore, where the fluid hydrocarbons have a variable gas-to-liquid ratio. The includes the steps of measuring a first gas-to-liquid ratio of the fluid hydrocarbons with the sensor module; outputting a signal representative of the first gas-to-liquid ratio of the fluid hydrocarbons to a variable speed drive; and applying an electric current from the variable speed drive to the motor to cause the motor to operate at a first rotational speed. The method continues with the steps of measuring a second gas-to-liquid ration of the fluid hydrocarbons with the sensor module, where the second gas-to-liquid ratio is greater than the first gas-to-liquid ratio; outputting a signal representative of the second gas-to-liquid ratio of the fluid hydrocarbons to the variable speed drive; and applying an electric current from the variable speed drive to the motor to cause the motor to operate at a second rotational speed that is faster than the first rotational speed.

DETAILED DESCRIPTION

Figure 1:
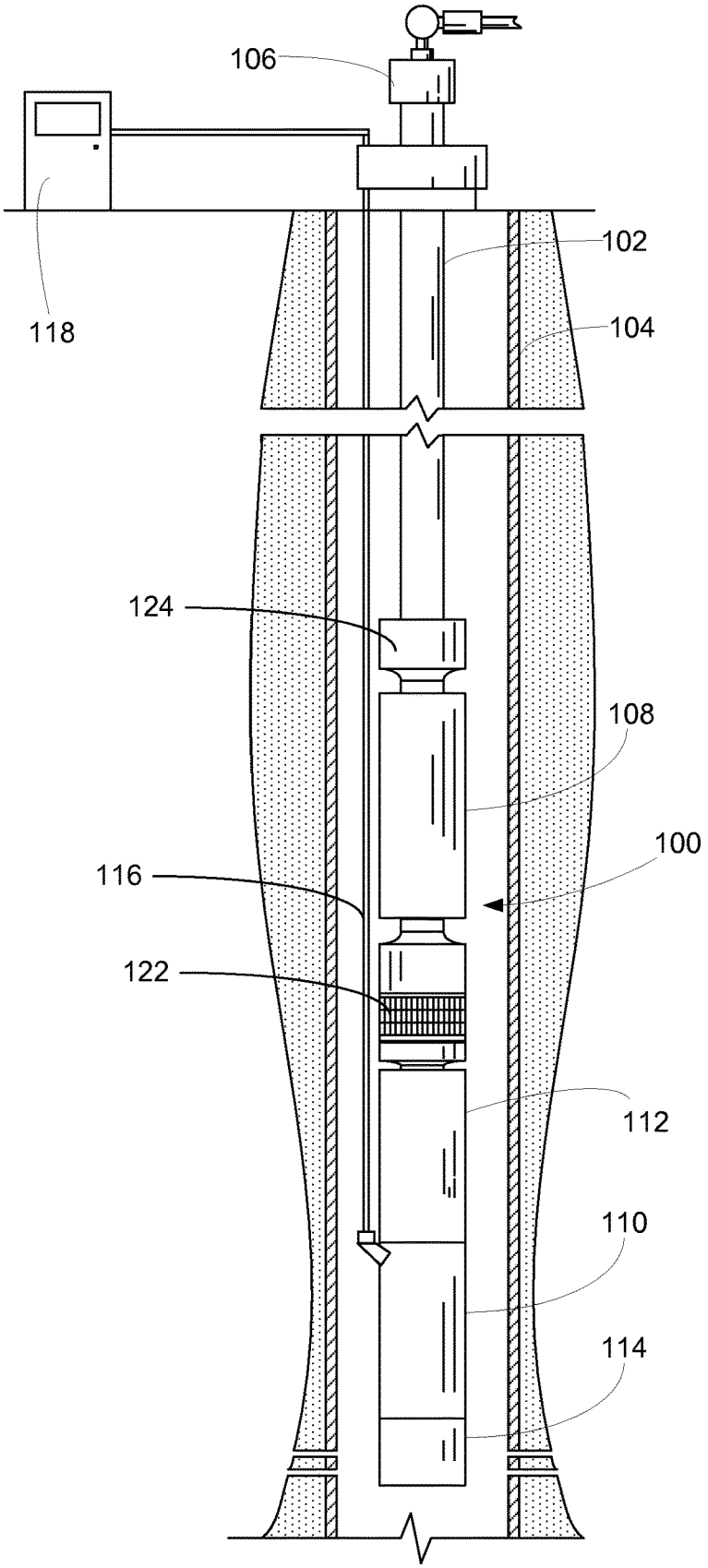
FIG. 1 depicts a submersible pumping system constructed in accordance with an embodiment of the present invention.

In accordance with an embodiment, FIG. 1 shows an elevational view of a pumping system 100 attached to production tubing 102. The pumping system 100 and production tubing 102 are disposed in a wellbore 104, which is drilled for the production of a fluid such as water or petroleum. The production tubing 102 connects the pumping system 100 to a wellhead 106 located on the surface. As used herein, the term "petroleum" refers broadly to all mineral hydrocarbons, such as crude oil, gas and combinations of oil and gas.

The pumping system 100 may include a fluid processor 108, a motor 110, a seal section 112, a sensor module 114, an electrical cable 116 and a variable speed drive 118. Although the pumping system 100 is primarily designed to pump petroleum products, it will be understood that embodiments of the present invention can also be used to move other fluids. It will also be understood that, although each of the components of the pumping system are primarily disclosed in a submersible application, some or all of these components can also be used in surface pumping operations.

The motor 110 may be an electric submersible motor that is provided power from the variable speed drive 118 on the surface by the electrical cable 114. When selectively energized, the motor 110 is configured to drive the fluid processor 108. The variable speed drive 118 controls the characteristics of the electricity supplied to the motor 110. In an embodiment, the motor 110 is a three-phase electric motor and the variable speed drive 118 controls the rotational speed of the motor by adjusting the frequency of the electric current supplied to the motor 110. Torque is transferred from the motor 110 to the fluid processor 108 through one or more shafts 120 (not shown in FIG. 1).

In some embodiments, the seal section 112 is positioned above the motor 110 and below the fluid processor 108. In some embodiments, the seal section 112 isolates the motor 110 from wellbore fluids in the fluid processor 108. The seal section 112 also accommodates the expansion of liquid lubricant from the motor 110 resulting from thermal cycling.

The sensor module 114 is configured to measure a range of operational and environmental conditions and output signals representative of the measured conditions. In an embodiment, the sensor module 114 is configured to measure at least the following external parameters: wellbore temperature, wellbore pressure and the ratio of gas to liquid in the wellbore fluids (gas fraction). The sensor module 114 can be configured to measure at least the following internal parameters: motor temperature, pump intake pressure, pump discharge pressure, vibration, pump and motor rotational speed, and pump and motor torque. The sensor module 114 may be positioned within the pumping system 100 at a location that permits the measurement of upstream conditions, i.e., the measurement of fluid conditions approaching the pumping system 100. In the embodiment depicted in FIG. 1, the sensor module 114 is attached to the upstream side of the motor 110. It will be appreciated, however, that the sensor module 114 can also be deployed with a tether in a remote position from the balance of the components in the pumping system 100.

In some embodiments, the fluid processor 108 is connected between the seal section 112 and the production tubing 102. The fluid processor 108 may include an intake 122 and a discharge 124. The fluid processor 108 is generally designed to produce wellbore fluids that have a predominately high gas fraction but that present significant volumes of liquid at start-up or on an intermittent basis. The fluid processor 108 includes turbomachinery components that are configured to increase the pressure of gas and liquid by converting mechanical energy into pressure head. When driven by the motor 110, the fluid processor 108 draws wellbore fluids into the intake 122, increases the pressure of the fluid and pushes the fluid through the discharge 124 into the production tubing 102.

Although only one of each component is of the pumping system 100 shown in FIG. 1, it will be understood that more can be connected when appropriate, that other arrangements of the components are desirable and that these additional configurations are encompassed within the scope of some embodiments. For example, in many applications, it is desirable to use tandem-motor combinations, gas separators, multiple seal sections, multiple pumps, and other downhole components.

It will be noted that although the pumping system 100 is depicted in a vertical deployment in FIG. 1, the pumping system 100 can also be used in non-vertical applications, including in horizontal and non-vertical wellbores 104. Accordingly, references to "upper" and "lower" within this disclosure are merely used to describe the relative positions of components within the pumping system 100 and should not be construed as an indication that the pumping system 100 must be deployed in a vertical orientation.

Figure 2:
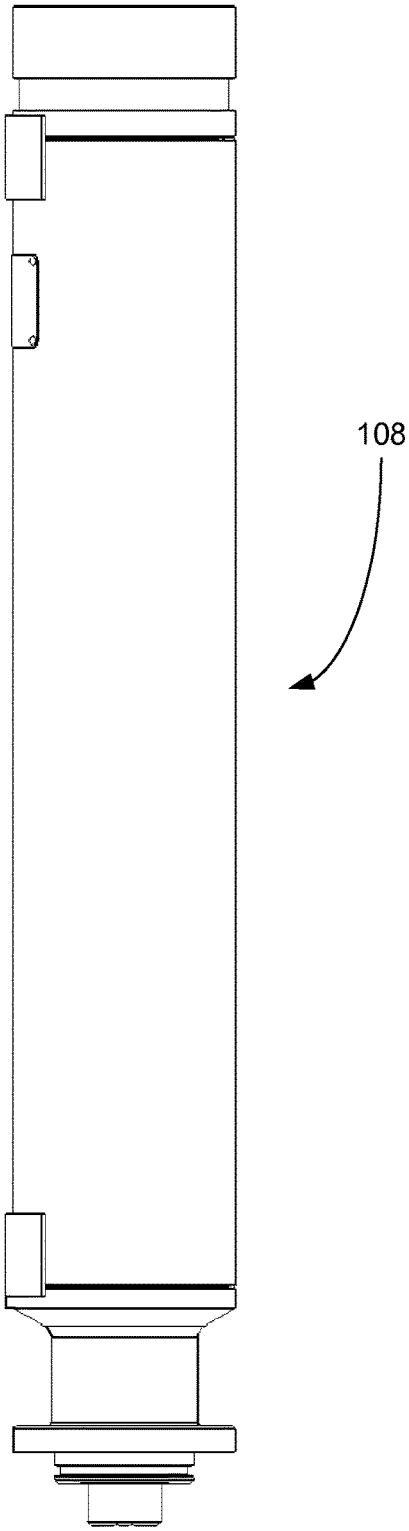
FIG. 2 provides an elevational view of the fluid processor of the pumping system of FIG. 1.
Figure 3:
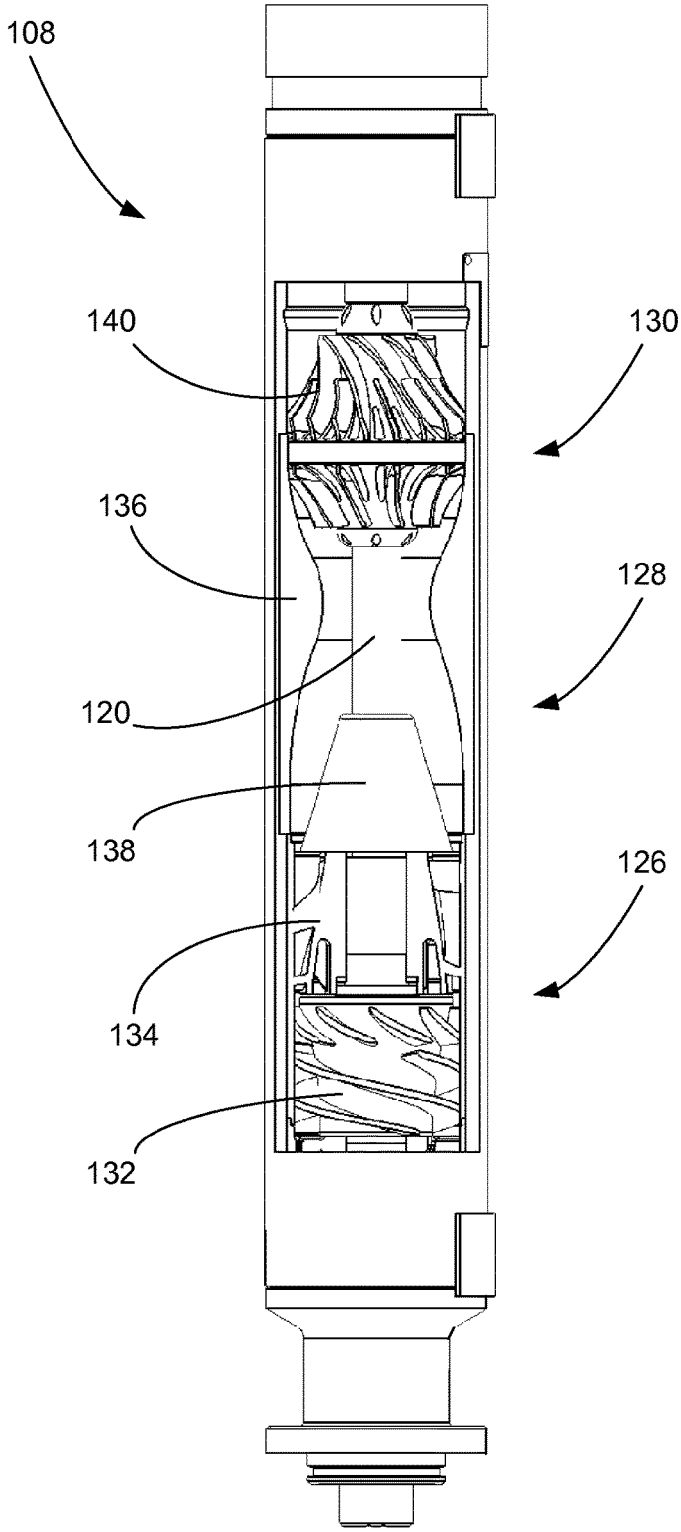
FIG. 3 provides a partial cut-away view of the fluid processor of FIG. 2.

Turning to FIGS. 2 and 3, shown therein are elevational and partial cut-away views, respectively, of the fluid processor 108. In some embodiments, the fluid processor 108 includes three sections: a fluid processing stage 126, an intermediate nozzle stage 128 and a compressor stage 130. Generally, the fluid processing stage 126 includes one or more impellers 132 and diffusers 134. The fluid processing stage 126 is used to pressurize fluids with a high liquid fraction. The intermediate nozzle stage 128 is designed to process fluids with a lower liquid fraction by reducing and dispersing liquid droplets in the fluid stream. The intermediate nozzle stage 128 may include a nozzle chamber 136 and a variable metering member 138. The gas compressor stage 130 is primarily intended to pressurize fluid streams with a high gas fraction. The compressor stage 130 may include one or more gas turbines 140.

Figure 4:
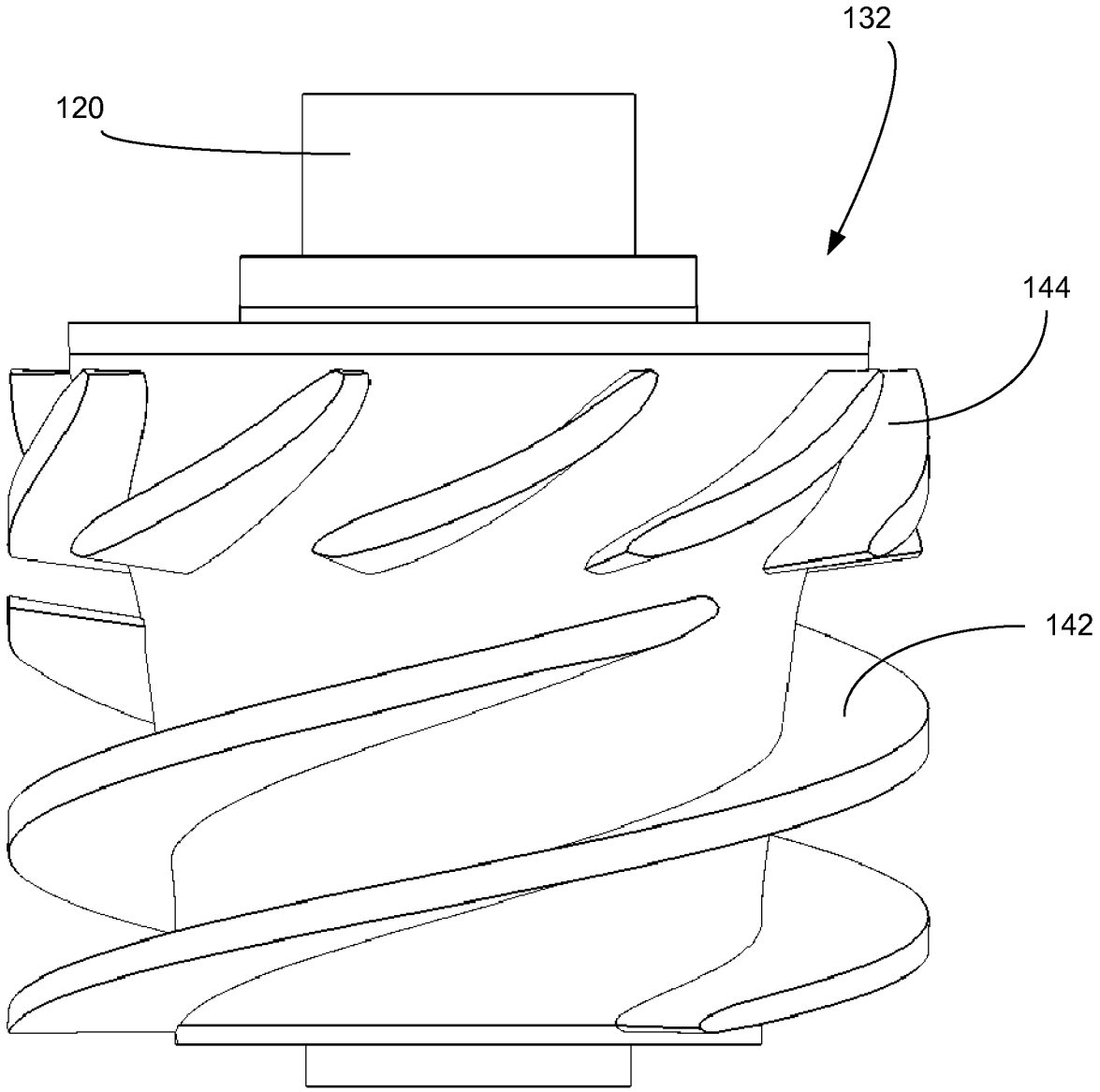
FIG. 4 provides an elevational view of a helical axial pump of the fluid processor of FIG. 3.

Turning to FIG. 4, shown therein is an elevational view of the impeller 132 constructed in accordance with an embodiment. The impeller 132 is connected to the shaft 120 and configured for rotation within the diffuser 134. The impeller 132 includes an upstream series of helical vanes 142 and a downstream series of axial vanes 144. The helical vanes 142 are designed to induce into the fluid processor 108 the flow of fluids with a significant liquid fraction. The axial vanes 144 accelerate the fluid in a substantially axial direction.

Figure 5:
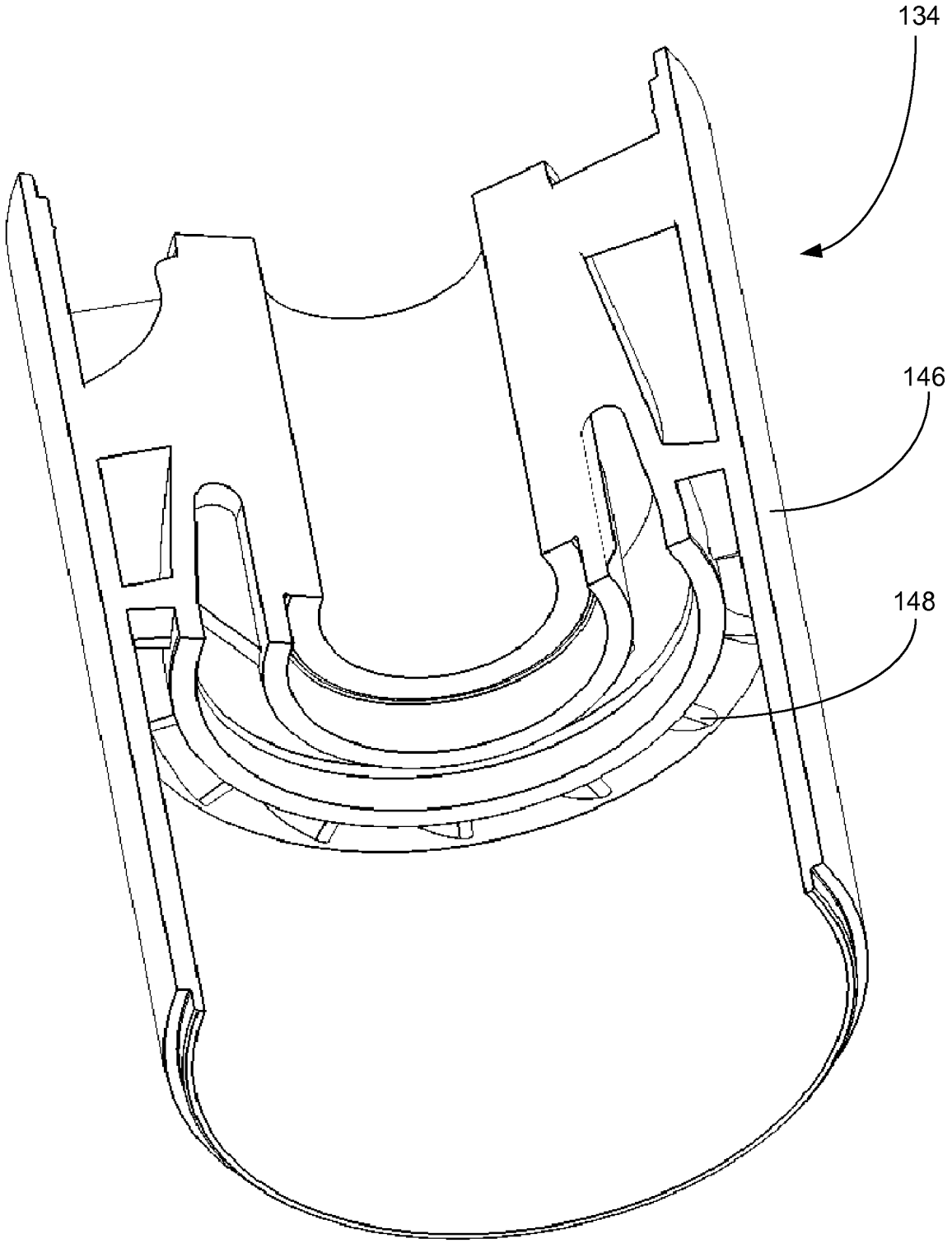
FIG. 5 presents a cross-sectional view of a diffuser of the fluid processor of FIG. 3.

Turning to FIG. 5, shown therein is a cross-sectional view of the diffuser 134. The diffuser 134 may include a diffuser shroud 146 and a series of diffuser vanes 148. The diffuser maintains a stationary position within the fluid processor 108. The diffuser 134 captures the fluid expelled by the impeller 132 and the diffuser vanes 148 reduce the axial velocity of the fluid, thereby converting a portion of the kinetic energy imparted by the impeller 132 into pressure head. Although a single impeller 132 and diffuser 134 are depicted in FIG. 3, the use of multiple pairs of impellers 132 and diffusers 134 is contemplated within the scope of additional embodiments.

Figure 6:
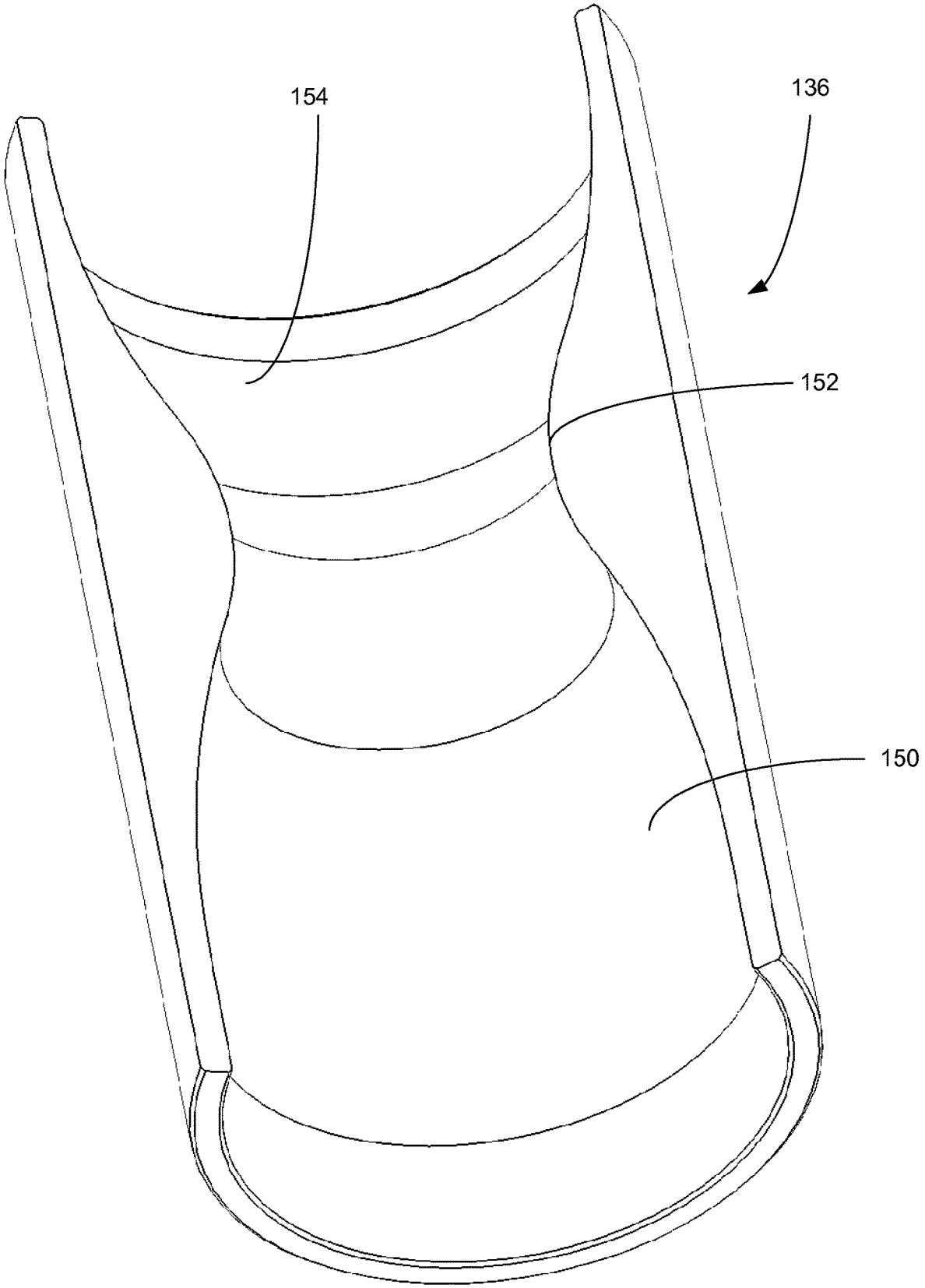
FIG. 6 presents a cross-sectional view of the nozzle chamber of the fluid processor of FIG. 3.

Turning to FIGS. 6 and 7, shown therein are perspective and cross-sectional views of the nozzle chamber 136 and variable metering member 138, respectively. The nozzle chamber 136 may be configured as a convergent-divergent novel that includes a convergent section 150, a throat 152 and a divergent section 154. In some embodiments, the nozzle chamber 136 is configured as a de Laval nozzle that includes an asymmetric hourglass-shape. In an embodiment, the nozzle chamber 136 is configured as a reverse-flow de Laval nozzle in which fluids accelerate from the convergent section 150 through the throat 152 and then decelerate in the divergent section 154. The acceleration and deceleration of the fluid passing through the nozzle chamber 136 causes entrained liquid droplets to disperse and homogenize with smaller droplet diameter.

Figure 7A:
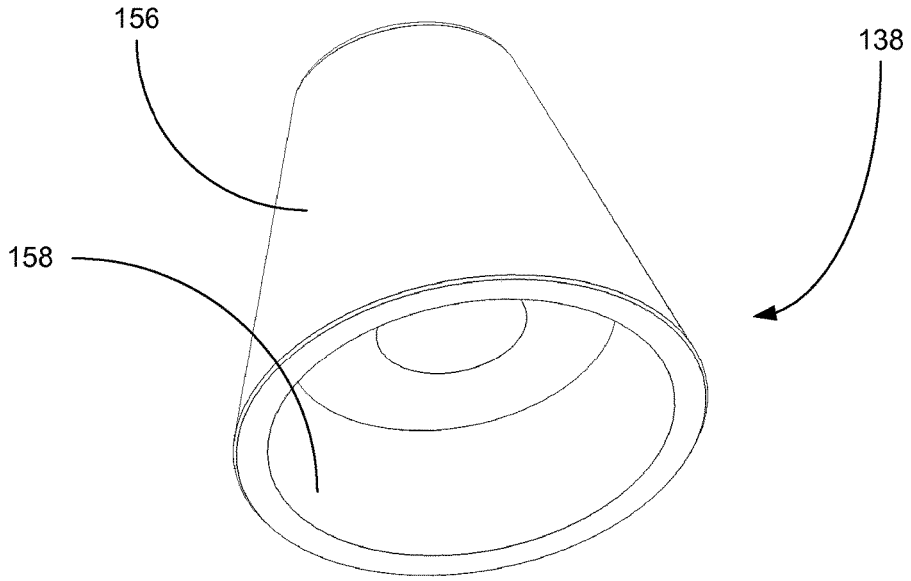
FIG. 7 presents a perspective view of the metering member of the fluid processor of FIG. 3.

The variable metering member 138 shown in FIG. 7A may include a frustoconical outer surface 156 and an interior bowl 158 that permits the passage of the shaft 120. The exterior conical surface 156 fits within the convergent section 150 of the nozzle chamber 136. The interior bowl 158 is positioned upstream toward the diffuser 134.

Figure 7B:
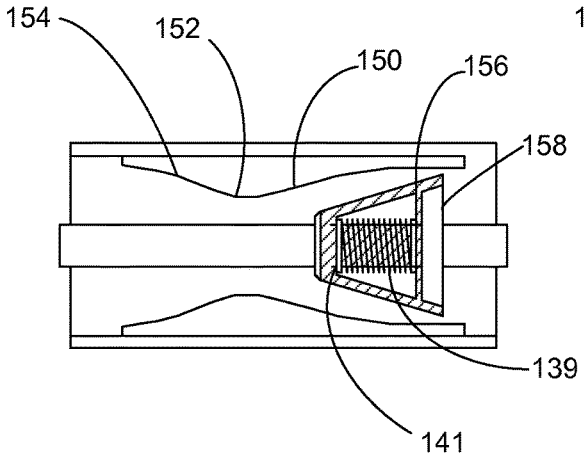
Figure 7C:
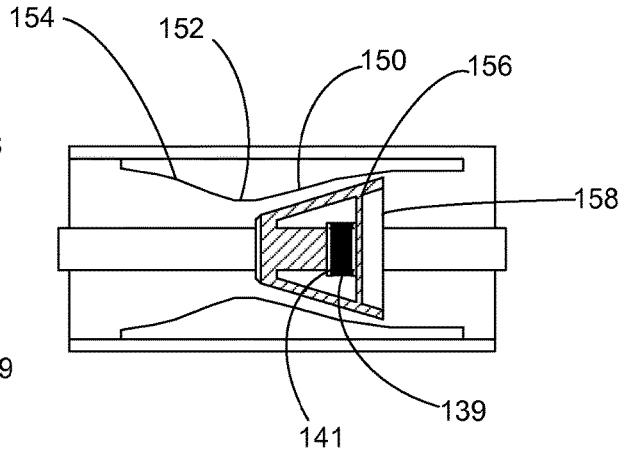

As shown in FIGS. 7A and 7B, The variable metering member 138 is configured to be axially displaced along the shaft 120. In some embodiments, the variable metering member 138 includes a spring 139 and a spring retainer clip 141. The spring retainer clip 141 is fixed at a stationary position on the shaft 120 and biases the variable metering member 138 in an open position adjacent the diffuser 134. As higher volumes of liquid pass from the diffuser 134, pressure exerted on the interior bowl 158 increases and the variable metering member 138 shifts downstream along the shaft 120 (as shown in FIG. 7C), thereby reducing the open cross-sectional area of the convergent section 150 of the nozzle chamber 136. Closing a portion of the nozzle chamber 136 under conditions of higher liquid loading creates a Venturi effect that compresses gas bubbles within the fluid stream and prevents damage to the downstream compressor stage 130. When the fluid discharged from the diffuser 134 includes a low liquid fraction, the force exerted by the spring 139 overcomes the hydraulic force exerted on the variable metering member 138 and the variable metering member 138 returns to a position adjacent the diffuser 134 (as shown in FIG. 7B) to permit the high-volume flow of high gas fraction fluid through the nozzle stage 128.

Figure 8:
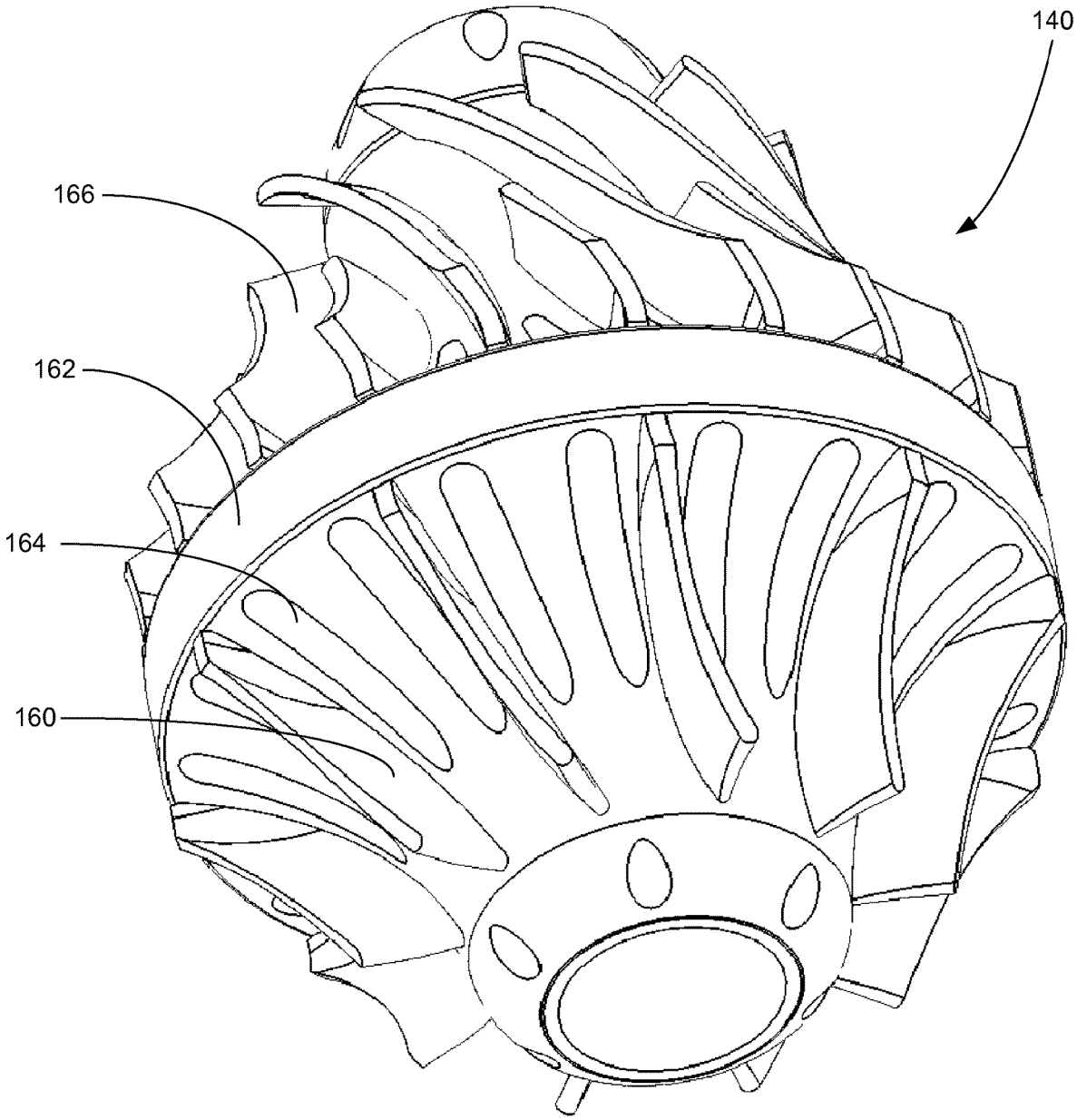
FIG. 8 presents a perspective view of a compressor stage of the fluid processor of FIG. 3.

Turning to FIG. 8, shown therein is a perspective view of the gas compressor turbine 140 of the gas compressor stage 130. The gas compression turbine 140 may include a series of upstream compressor vanes 160, a hub 162, a series of ports 164 passing from the upstream side of the hub 162 to the downstream side of the hub 162 and a series of downstream compressor vanes 166. The upstream compressor vanes 160 are configured to induce the flow of fluid through the gas compressor stage 130. Fluid passes through the hub 162 through the ports 164 and into the downstream compressor vanes 166. The downstream compressor vanes 166 are designed to increase the pressure of the fluid. In some embodiments, the gas compressor stage 130 includes a series of multi-axial and radial centrifugal gas compressor stages.

The operation of the fluid processor 108 is adjusted based on the condition of the fluid in the wellbore 104. Based on information provided by the sensor module 114 about the gas-to-liquid ration in the wellbore fluid, the variable speed drive 118 adjusts the electric current provided to the motor 110, which in turn, adjusts the rotational speed of the rotary components of the fluid processor 108. When the wellbore fluid exhibits a high liquid-to-gas ratio (above about 5% LVF), the motor 110 operates at a relatively low speed. At lower speeds, the fluid processing stage 126 is effective and pumps the high liquid-fraction fluid through the fluid processor 108. At these lower rotational speeds, the compressor stage 130 does not significantly increase or impede the flow of fluid through the fluid processor 108.

When the sensor module 114 detects the presence of wellbore fluids with a higher gas-to-liquid ratio, the variable speed drive 118 increases the rotational speed of the motor 110, which in turn, increases the rotational speed of the rotary components in the fluid processor 108. The higher rotational speed allows the compressor stage 130 to increase the pressure of the high gas fraction fluid. During operation, the nozzle stage 136 meters the flow of fluid into the compressor stage 130 and reduces the size of liquid droplets entrained in the fluid stream.

In some embodiments, the fluid processor 108 is operated in a low speed "pump" mode when the liquid fraction is above about 8%. When the liquid fraction is below about 8%, the speed of the fluid processor 108 can be increased to optimize the operation of the compressor stage 130. Thus, in some embodiments, the operation of the fluid processor 108 is adjusted automatically to optimize the movement of fluids depending on the gas-to-liquid ratio of the fluids. Although the sensor module 114 can be used to provide the gas and liquid composition information to control the operation of the fluid processor 108, it may also be desirable to control the operation of the fluid processor 108 based on the torque requirements of the motor 110. An increase in torque demands may signal the processing of fluids with higher liquid-to-gas ratios.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A fluid processor for use in a downhole pumping operation in which wellbore fluids are produced from a wellbore, the fluid processor comprising:

a fluid processing stage;

a nozzle stage, wherein the nozzle stage comprises:

a nozzle chamber; and a variable metering member configured for axial displacement within the nozzle chamber, wherein the variable metering member includes a spring that applies a force on the variable metering member in an upstream direction toward an open position, and wherein the variable metering member is configured to automatically move downstream to close a portion of the nozzle chamber when the pressure exerted by the wellbore fluid on the variable metering member exceeds the force applied by the spring; and a gas compressor stage.

2. The fluid processor of claim 1, wherein the fluid processing stage comprises:

an impeller; and a diffuser.

3. The fluid processor of claim 2, wherein the impeller is a helical-axial impeller that comprises:

a plurality of helical vanes; and a plurality of axial vanes.

4. The fluid processor of claim 1, wherein the nozzle chamber comprises:

a convergent section;

a throat; and a divergent section.

5. The fluid processor of claim 4, wherein the nozzle chamber comprises a de Laval nozzle.

6. The fluid processor of claim 4, wherein the nozzle chamber comprises a de Laval nozzle configured for reverse-direction flow such that fluids exiting the nozzle chamber are accelerated from the convergent section through the throat before decelerating through the divergent section before entering the gas compressor stage.

7. The fluid processor of claim 4, wherein the variable metering member comprises:

a frustoconical outer surface; and an interior bowl.

8. The fluid processor of claim 1, wherein the gas compressor stage comprises a gas compressor turbine.

9. The fluid processor of claim 8, wherein the gas compressor turbine comprises:

a hub;

a series of upstream compressor vanes connected to the hub;

a series of downstream compressor vanes connected to the hub; and a series of ports passing through the hub.

10. A downhole pumping system for producing wellbore fluids that comprise both liquid and gas fractions, the downhole pumping system comprising:

a motor;

a seal section connected to the motor; and a fluid processor driven by the motor and connected to the seal section, wherein the fluid processor comprises:

a fluid processing stage;

a nozzle stage downstream from the fluid processing stage, wherein the nozzle stage comprises:

a nozzle chamber; and a variable metering member configured for axial displacement within the nozzle chamber, wherein the variable metering member includes a spring that applies a force against the variable metering member in an upstream direction toward an open position, and wherein the variable metering member is configured to automatically move downstream to close a portion of the nozzle chamber when pressure exerted by the wellbore fluid on the variable metering member exceeds the force applied by the spring; and a gas compressor stage downstream from the nozzle stage.

11. The downhole pumping system of claim 10, wherein the fluid processing stage comprises:

an impeller; and a diffuser.

12. The downhole pumping system of claim 10, wherein the gas compressor stage comprises a gas compressor turbine.

13. A fluid processor for use in producing wellbore fluids from a wellbore, the fluid processor comprising:

a fluid processing stage that includes an impeller that is configured to rotate at a first speed to pump wellbore fluids with a first liquid-to-gas ratio that is above about 5% liquid-volume-fraction (LVF);

a nozzle stage downstream from the fluid processing stage, wherein the nozzle stage comprises:

a nozzle chamber; and a variable metering member configured for axial displacement within the nozzle chamber, wherein the variable metering member includes a spring that applies a force against the variable metering member in an upstream direction toward an open position, and wherein the variable metering member is configured to automatically move downstream to close a portion of the nozzle chamber when the wellbore fluids have the first liquid-to-gas ratio and the pressure exerted by the wellbore fluid on the variable metering member exceeds the force applied by the spring; and a gas compressor stage downstream from the nozzle stage, wherein the gas compressor stage includes a compressor gas turbine that is configured to rotate at a second speed that is higher than the first speed to force wellbore fluids out of the fluid processor when the wellbore fluids have a second liquid-to-gas ratio that is less than the first liquid-to-gas ratio.

14. The fluid processor of claim 13, wherein the nozzle chamber comprises:

a convergent section;

a throat downstream from the convergent section; and a divergent section downstream from the throat.

15. The fluid processor of claim 13, wherein the nozzle chamber has an asymmetric hourglass shape.

* * * * *